United States Patent [19]

Holmes

[11] 4,375,324

[45] Mar. 1, 1983

[54] DISPOSABLE PROCESSING KIT CONTAINING FILM

[75] Inventor: William A. Holmes, Marbelhead, Mass.

[73] Assignee: Polaroid Corporation, Cambridge, Mass.

[21] Appl. No.: 305,961

[22] Filed: Sep. 28, 1981

[51] Int. Cl.[3] ..... G03D 5/06

[52] U.S. Cl. ..... 354/303; 354/318

[58] Field of Search ..... 354/317, 318, 301, 303, 354/305; 352/130

[56] References Cited

U.S. PATENT DOCUMENTS

| | | | |
|---|---|---|---|
| 2,880,657 | 4/1959 | Bartlett | 95/12 |
| 3,667,361 | 6/1972 | Meggs et al. | 95/13 |
| 4,167,318 | 9/1979 | Wareham | 354/298 |
| 4,212,521 | 7/1980 | Stella | 352/130 |
| 4,212,527 | 7/1980 | Fischer | 354/275 |
| 4,272,178 | 6/1981 | Bendoni et al. | 354/298 |
| 4,307,955 | 12/1981 | Cocco et al. | 354/303 |
| 4,309,100 | 1/1982 | Bendoni et al. | 354/317 |

OTHER PUBLICATIONS

Research Disclosure, Jan. 1981, pp. 53 and 54.

*Primary Examiner*—L. T. Hix

*Assistant Examiner*—Alan Mathews

*Attorney, Agent, or Firm*—Alfred E. Corrigan

[57] ABSTRACT

A kit includes a housing for receiving various elements of the kit, i.e., a film assemblage containing unexposed instant transparency film, a supply of sheet material wound about a roller, a processing liquid applicator and a take-up roller. The kit is purchased as a unit, the film assemblage removed therefrom, photographically exposed in a conventional 35 mm camera, and then returned to the kit where the leader of the exposed film is attached to the take-up roller and the kit closed. It is then inserted into the processor wherein a drive is adapted to rotate the take-up roller in a direction so as to wind a laminate comprised of the exposed film, a layer of processing liquid and the sheet material upon the take-up roller for a period of time sufficient to initiate the formation of visible images in the laminate. The film assemblage's film spool and the sheet material's roller are then driven in a direction so as to remove the laminate from the take-up roller, strip the exposed film from the sheet material, and simultaneously rewind the film onto its spool and the sheet material onto its roller. The processed film and its cassette may then be removed from the kit and the remainder of the kit discarded.

8 Claims, 9 Drawing Figures

DISPOSABLE PROCESSING KIT CONTAINING FILM

BACKGROUND OF THE INVENTION

1. Field of the Invention

This invention relates to a disposable kit for use in developing a roll of instant type film.

2. Description of the Prior Art

The present invention relates to a disposable or throw-away kit especially constructed for use in a film processor wherein a roll of exposed instant type transparency film is to be processed so as to produce visible images. It is known that film of the type described above may be photographically exposed in a conventional 35 mm camera and then placed in a processor wherein a liquid is spread across a layer of the film so as to initiate the formation of visible images in the film. For example, U.S. Pat. No. 4,167,318 shows a film assemblage wherein a processing composition or liquid is spread between the film's positive layer and its emulsion layer to initiate the formation of visible images in the film. U.S. Pat. No. 4,212,527 describes similar structure except therein the processing liquid is spread between the film and a sheet of transparent material. While the systems in the above patents perform their function, i.e., the production of instant transparencies, the projection of the images could be enhanced if the positive transparency were removed from the laminate, rather than being an integral part thereof as described in said patents.

U.S. Pat. No. 2,880,657 describes a photographic system wherein a strip of photosensitive material is withdrawn from a cassette, photographically exposed, and then superposed with a strip of image-receiving material immediately subsequent to a processing liquid being deposited between the two strips. The laminate comprised of the two strips and the intermediate layer of processing liquid is then wound upon a rotating drum where it remains until the end of a predetermined processing period, at the end of which the image-receiving strip is peeled from the photosensitive strip and moved past a projection station. Also, see U.S. Pat. No. 4,212,521 wherein an emulsion layer is stripped from an image-receiving layer so as to increase the transmission of light through the image-receiving layer during projection of the images therein. However, while these systems provide for the processing of a film laminate wherein the emulsion layer is peeled from the image-receiving layer prior to transmitting light through the latter for projection purposes, they do not lend themselves to use in a conventional 35 mm camera.

Pages 53 and 54 of the January, 1981 edition of RESEARCH DISCLOSURE disclose three systems for processing a roll of instant type film. Basically, these systems provide for the placement of a film cassette containing an exposed roll of instant type film in a film processor of the type including a processing fluid dispensing station, a roll of sheet material and a take-up spool upon which the film and sheet material are adapted to be wound with a layer of processing fluid location therebetween. In one of the systems, after the development is completed, the composite of sheet material and film is removed from the spool and peeled apart. It is not known if the emulsion layer of the film is removed during the peeling apart of the film and the sheet material but regardless, this type of processing leaves much to be desired insofar as the sheet material containing the processing fluid must be safely disposed of so as to prevent injury or damage to one or his possessions.

U.S. Pat. No. 3,667,361 shows a film cassette containing a loop of film which is adapted to be photographically exposed and a processing liquid applicator which is adapted to be opened by reverse movement of the exposed film, thereby enabling it to apply a coating of the liquid to the film to initiate the formation of visible images within the film. Thereafter, the film cassette is broken and the developed film removed therefrom. However, the configuration of the film cassette precludes its use in conventional 35 mm cameras and breaking the film cassette so as to remove the processed film therefrom leaves something to be desired.

U.S. Pat. No. 4,272,178 shows a film assemblage including a film cassette of the type adapted for use in conventional 35 mm cameras. The film cassette contains a roll of instant-type 35 mm transparency film, a supply of processing liquid and a length of sheet material. After the film has been photographically exposed, it is removed from the camera and placed within a processor where, during closing of the processor's loading door, a pair of knives cut a portion of the film cassette so as to enable the exit slot of the film cassette to be enlarged to thereby permit the simultaneous passage therethrough of the film, the processing liquid container and the sheet material. During processing, the film and sheet material are superposed and passed through a pair of rollers which rupture the processing liquid container and spread its contents between the film and the sheet material to initiate the formation of visible images within either the film or the sheet material. Thereafter the film and sheet material may be stripped from each other or they may permanently remain in superposed relation. Again, as with the '361 patent, the severing of a wall of the film cassette can present problems, both mechanically and cost wise.

SUMMARY OF THE INVENTION

The instant invention relates to a disposable kit which is adapted to be placed in a processor wherein it is used in the processing of a roll of exposed film, which film is an element of the kit. The kit includes a housing for receiving a film assemblage including a film cassette of the type adapted for use in conventional 35 mm cameras. Located within the film cassette is a roll of unexposed 35 mm instant-type transparency film coiled about a film spool rotatably supported within the film cassette with one end of the film secured to the film spool and its other end extending to the exterior of the film cassette via a film exit opening. Also mounted within the housing is a roller which supports a coil of flexible sheet material having first and second ends, an applicator containing a supply of processing liquid, and a take-up roller. The first end of the sheet material is secured to its roller and the second end of the sheet material extends across a discharge nozzle of the applicator to a point whereat it is secured to the take-up roller.

The kit is adapted to be purchased as a unit, the film cassette removed and the film photographically exposed, and the film cassette reinserted into the kit where the second end of the exposed film is attached to the take-up roller.

The kit is then closed and placed within a processor where elements of a drive system extend through openings in a side wall of the housing to engage portions of the take-up roller, the roller for the sheet material and the film spool. The drive system is actuated so as to provide an input only to the take-up roller. This input rotates the take-up roller in a direction so as to simultaneously unwind the exposed film from its film spool and the sheet material from its roller and superpose them upon the take-up roller. Initial movement of the sheet material past the nozzle of the processing liquid applicator is effective to open the nozzle thereby enabling it to apply a continuous coating of the liquid to one side of the sheet material. Accordingly, a laminate comprised of a layer of the processing liquid sandwiched between the exposed film and the sheet material is coiled upon the take-up roller. The input from the drive system is terminated after the exposed portion of the film has been wound upon the take-up roller and the laminate is allowed to remain thereon for a predetermined period of time, e.g., one minute. At the end of this time period visible images will have been formed in the laminate, preferably in the film. The drive system is again actuated so as to drive the sheet material roller and the film spool in directions which will unwind the laminate from the take-up roller and strip the film from the sheet material while simultaneously rewinding the film onto its spool and the sheet material onto its roller. After the processed film has been substantially unwound from the take-up roller, the drive system is shut down and the second end of the processed film detached from the take-up roller. The film cassette containing the processed film may then be removed from the kit and the film cut and mounted for subsequent viewing. Also, the door of the kit may then be closed thereby safely containing the residue of the processing operation, and the kit may then be properly disposed of.

An object of the invention is to provide a disposable kit including a roll of unexposed photographic film which, subsequent to being exposed, is adapted to be processed by other components of the kit upon the insertion of the kit into a processor.

Another object of the invention is to provide a disposable kit which includes a film cassette of the type adapted for use in conventional 35 mm cameras, an unexposed roll of instant-type transparency film, and the materials for developing the film subsequent to its exposure.

Other objects of the invention will in part be obvious and will in part appear hereinafter.

The invention accordingly comprises the apparatus possessing the construction, combination of elements and arrangement of parts which are exemplified in the following detailed disclosure, and the scope of the application of which will be indicated in the claims.

BRIEF DESCRIPTION OF THE DRAWINGS

For a fuller understanding of the invention, reference should be had to the following detailed description taken in conjunction with the accompanying drawings wherein.

DETAILED DESCRIPTION OF THE INVENTION

Figure 1:
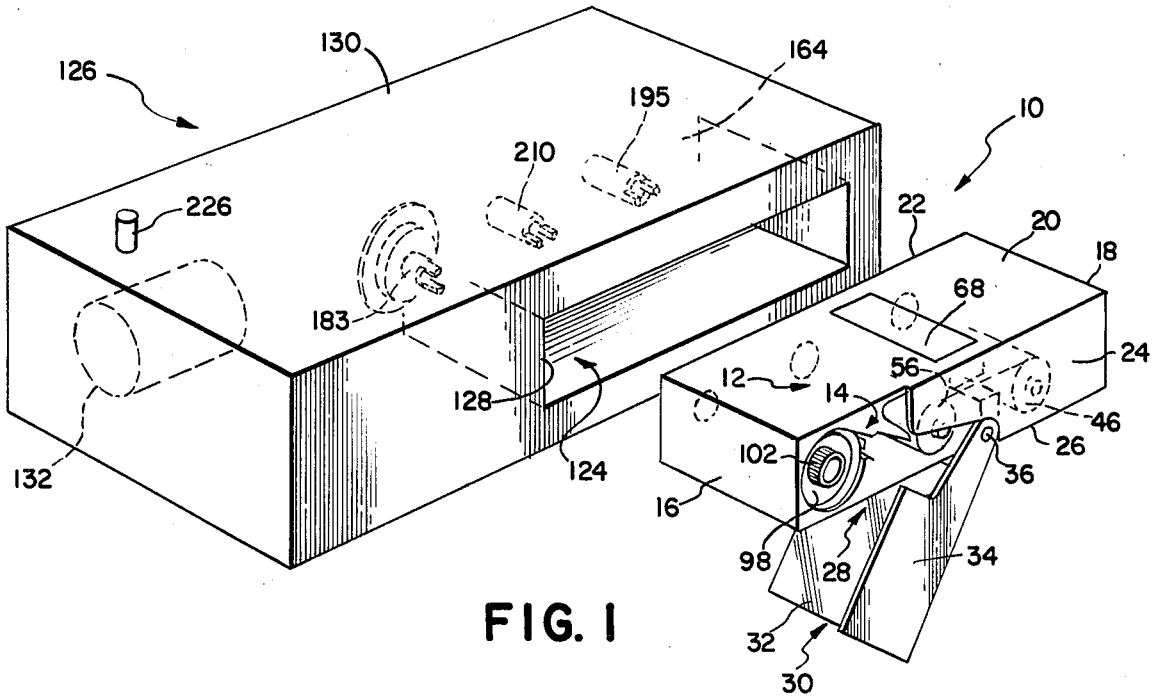
FIG. 1 is a perspective view of a disposable kit and a processor specifically adapted to receive the kit, the kit being shown with its loading door open.
Figure 8:
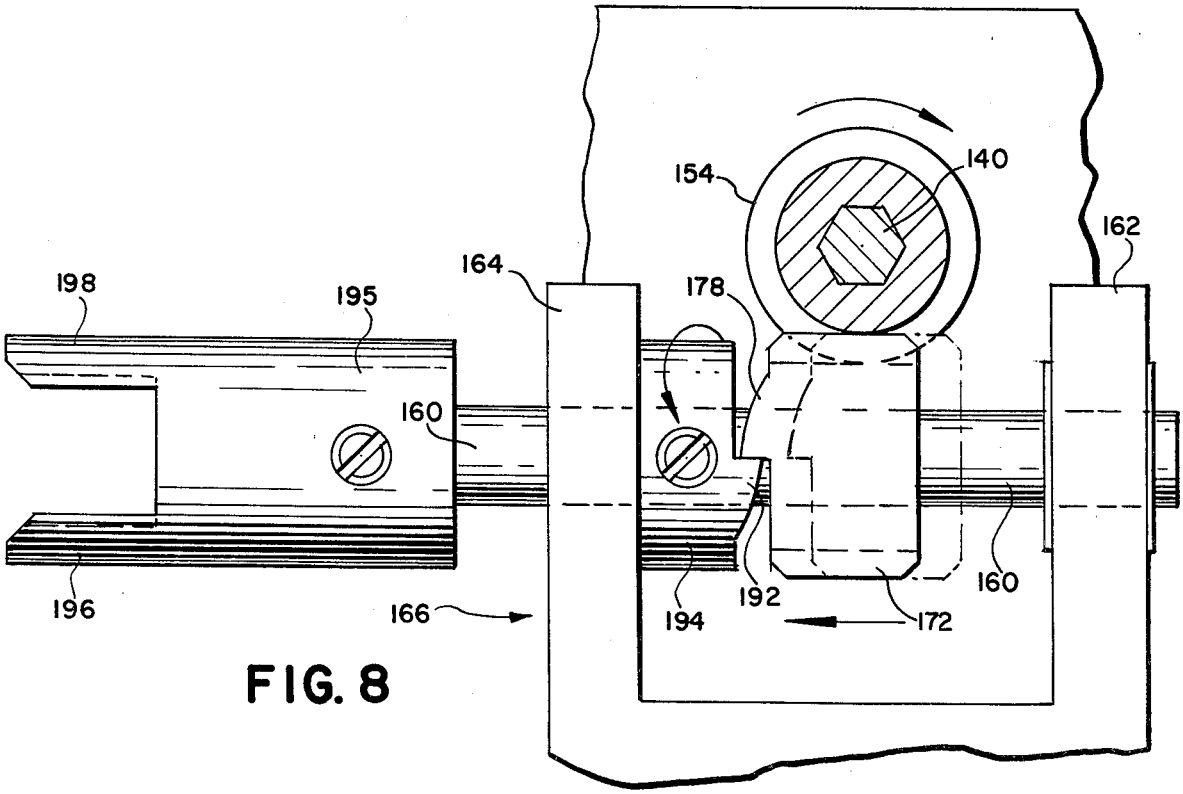
FIG. 8 is an end elevational view of a portion of the drive system shown in FIG. 6.
Figure 2:
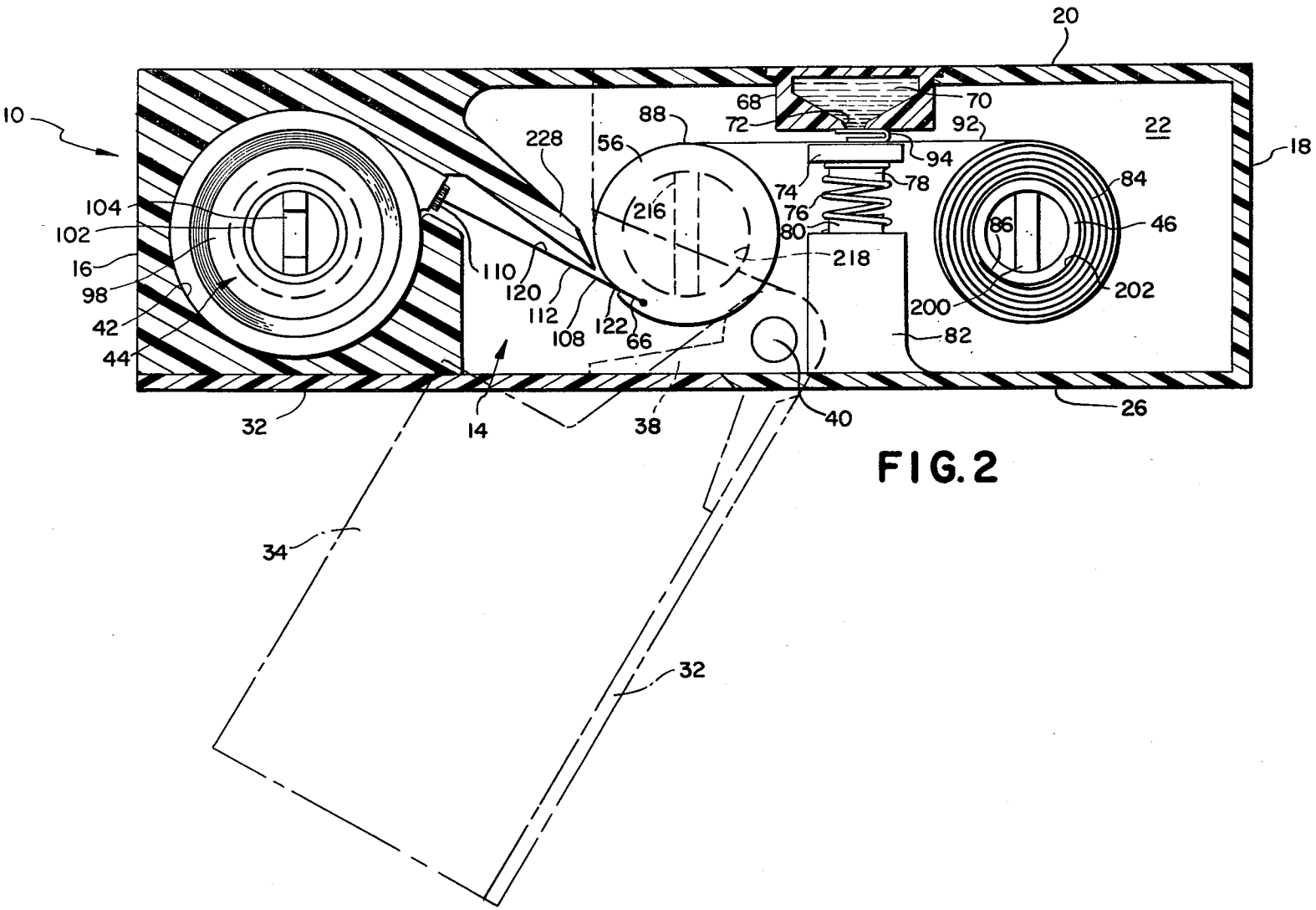
FIG. 2 is an enlarged side elevational view, partly in section, of the disposable kit.
Figure 3:
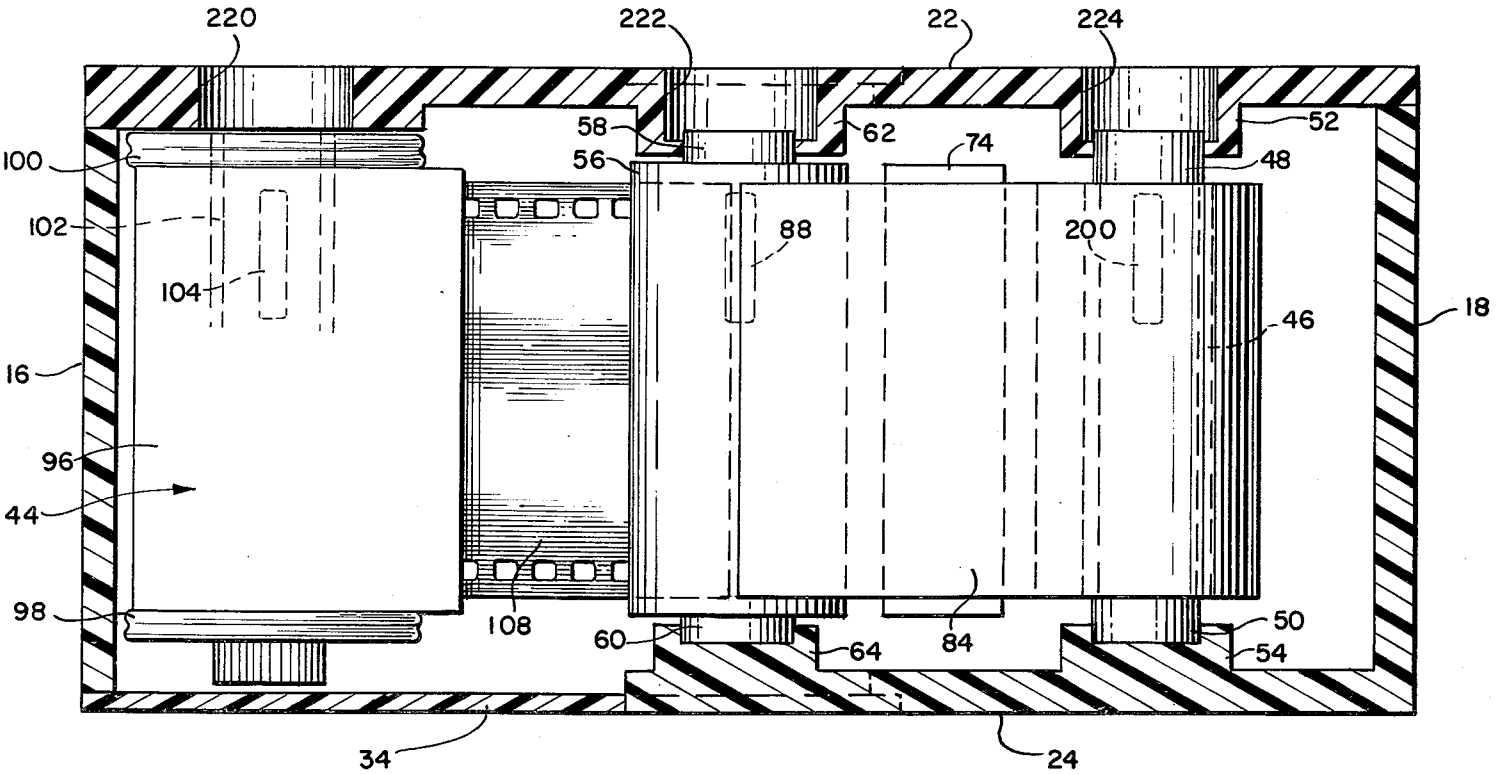
FIG. 3 is a top elevational view, partly in section, of the disposable kit, with portions omitted for clarity.

Reference is now made to the drawings and, in particular, to FIGS. 1–3 wherein is shown a disposable kit 10 which incorporates the features of the instant invention. The kit 10 includes a housing 12 which defines a chamber 14 for receiving components of the kit. The housing 12 includes a pair of end walls 16 and 18 interconnected by a top wall 20 and a side wall 22. The housing 12 also includes a side wall 24 and a bottom wall 26 which extend from the end wall 18 towards but short of the opposite end wall 16 so as to define an opening 28 via which access may be had to the chamber 14. The opening 28 is closed by an L-shaped door 30 having a first section 32 which complements the bottom wall 26 so as to completely close off the bottom of the housing 12, and a second section 34 which complements the side wall 24 in a corresponding manner. The second section 34 is pivotally coupled to the housing 12 at 36 while a flange 38 (see FIG. 2) extends upwardly from the far side of the first section 32 for pivotally connecting the door 30 to the housing about a pivot 40. Suitable means (not shown) are provided for releasably maintaining the door 30 in its closed position.

As best shown in FIGS. 2 and 3, the chamber 14 includes on its left end a compartment 42 which is configured to receive a film assemblage 44. A roller 46 is mounted in the right side of the chamber 14 such that its hollow journals 48 and 50 are rotatably supported by a pair of cylindrical bearing surfaces 52 and 54 which extend inwardly toward each other from the side walls 22 and 24, respectively. A take-up roller 56 is also mounted between the side walls 22 and 24 such that its hollow journals 58 and 60 are rotatably supported within a pair of inwardly extending cylindrical bearings 62 and 64 respectively which, like the bearings 52 and 54, are integrally formed in the side walls. The surface of the take-up roller 56 is provided with a longitudinally extending slot 66 (see FIG. 2) which is adapted to receive an end of a film strip, as will be explained shortly.

Mounted within an opening in the top wall 20 of the kit 10 is an applicator 68 containing a supply of processing liquid 70 which is adapted to be dispensed therefrom via a discharge nozzle 72. Mounted in line with and extending along the entire length of the nozzle 72 is a pressure pad 74 which is resiliently biased toward the nozzle 72 by a spring 76. One end of the spring 76 encircles a boss 78 on the bottom side of the pressure pad 74 while the opposite end of the spring 76 encircles a boss 80 extending upwardly from a pedestal 82.

A strip of flexible sheet material 84 having a first end 86 secured to the roller 46 is coiled thereabout and then extends between the discharge nozzle 72 and the pressure pad 74 and then to the take-up roller 56 whereat its second end 88 is fixedly secured. The sheet material includes a support 90 formed, e.g., from Mylar, and a layer of water absorbing material, e.g., gelatin 92. Extending upwardly from the gelatin coated side of the sheet material 84 is a seal 94 which has one end fixedly secured to the sheet material 84 and its opposite end in releasable sealing engagement with the discharge nozzle 72.

The film assemblage 44 includes a generally cylindrically shaped film cassette 96 of the type presently available for use in conventional 35 mm cameras. The film cassette 96 includes at its opposite ends apertured end caps 98 and 100 which rotatably support the opposite ends of a hollow, cylindrically shaped, film spool 102. Fixedly mounted within the film spool 102 is a generally planar member 104 which bisects the passageway through the hollow spool and which is adapted to be driven by a camera's film rewind mechanism so as to rotate the film spool 102 in a given direction. A length of photographic film 106 is wound about the film spool with a first end (not shown) fixedly attached to the film spool and its second end 108 extending to the exterior of the film cassette 96 via a lighttight exit slot 110.

Figure 4:
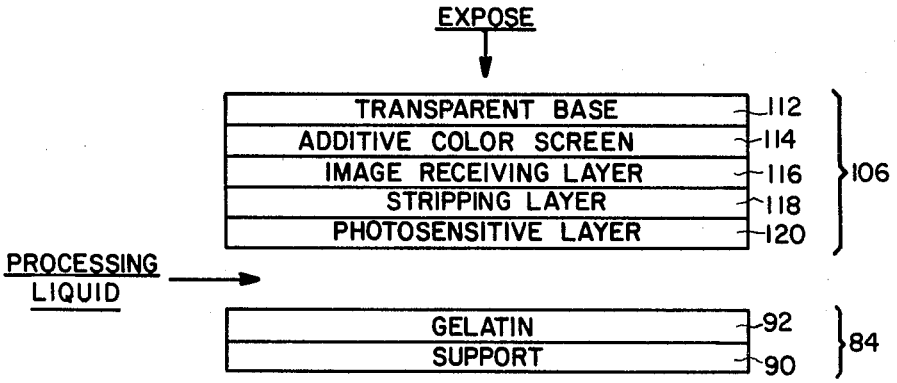
FIG. 4 is a diagrammatic view of a laminate including a layer of processing liquid sandwiched between a strip of exposed film and a flexible sheet material.

The film 106 preferably takes the form shown in FIG. 4. Basically, the film 106 includes a plurality of layers including, in sequence, a transparent base 112 through which an exposure is to be made, as indicated by the arrow, an additive color screen 114, an image receiving layer 116, a stripping layer 118 and a photosensitive layer 120. As will be more fully explained hereinafter, a coating of processing liquid is adapted to be spread, preferably upon the gelatin layer of the sheet material 84 prior to superposing it with the photosensitive layer 106 to initiate the formation of visible images within the image-receiving layer 116.

The kit 10 is adapted to be purchased as a unit, i.e., it includes a film assemblage 44 containing an unexposed roll of film, preferably of the instant 35 mm color transparency type, and all of the materials necessary for the processing of the film. The film assemblage 44 is removed from the kit 10 and inserted into a camera where the second end 108 of the unexposed film 106 is attached to the camera's film advance mechanism. After the film 106 has been withdrawn from the film cassette 96 and photographically exposed, it is rewound into the film cassette 96 until only the second end 108 of the exposed film 106 remains outside of the film cassette 96. The film cassette 96 may then be removed from the camera and replaced within the kit 10 where its second end 108 is releasably secured within a slot 122 which extends longitudinally along the length of the surface of the take-up roller 56, as best shown in FIGS. 1 and 2. The L-shaped door 30 is then closed and the kit inserted into a chamber 124 of a processor 126 via an opening 128 in a processor housing 130. The housing 130 may be provided with a door (not shown) for closing the opening 128 to thereby render the chamber 124 lighttight; or, the housing 12 (or at least the side wall 24 and the second section 34 of the door 30) may be made from an opaque material.

Figure 9:
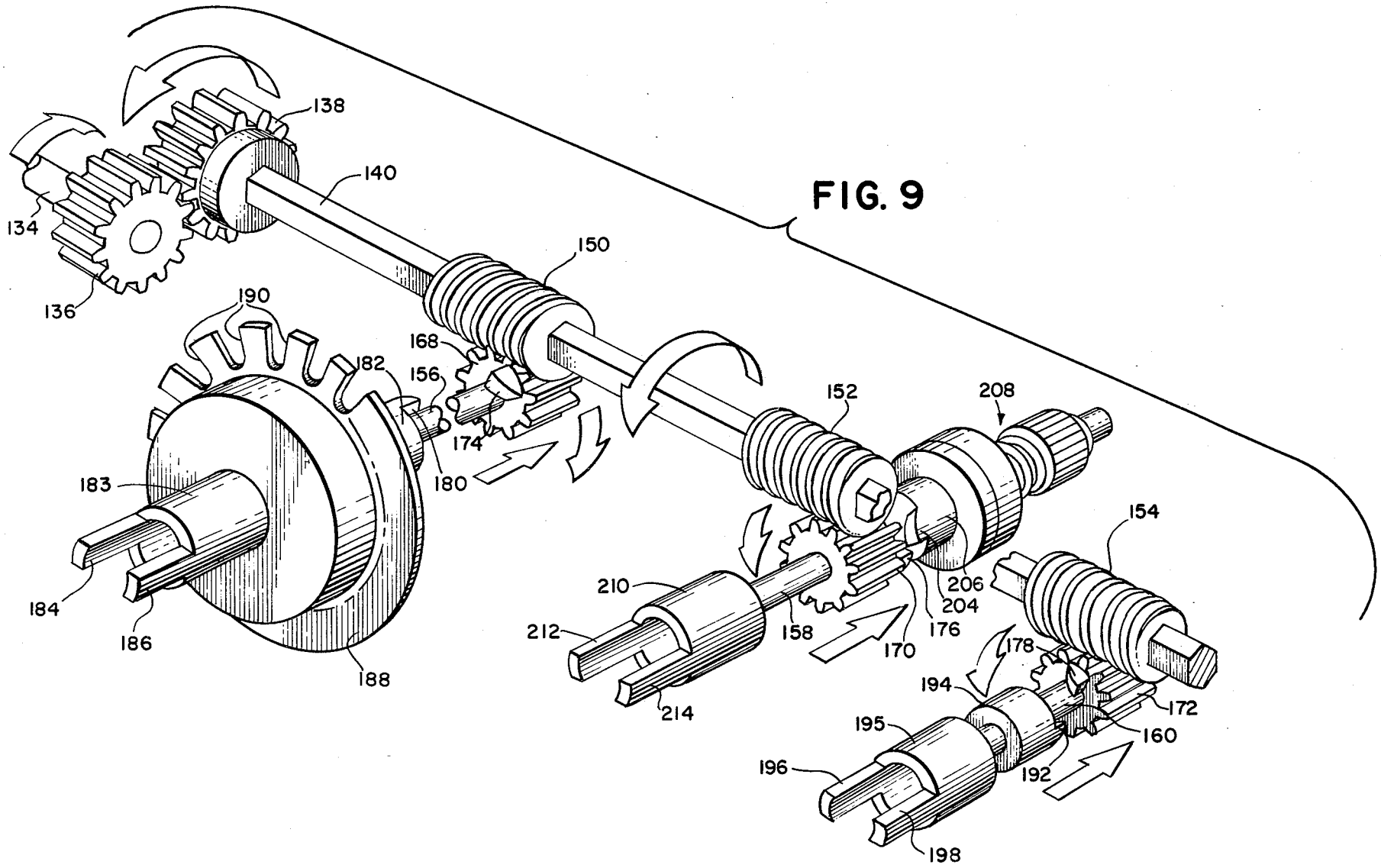
FIG. 9 is an enlarged perspective view of the drive system.

The processor 126 includes a drive system comprised of a reversible electric motor 132 having an output shaft 134 to which a gear 136 is secured. The gear 136 is in mesh with a gear 138 which, in turn, is fixed to a shaft 140. The shaft 140 is six-sided in cross section and is provided at its opposite ends with cylindrical journals 142 (only one being shown) which are rotatably supported by a pair of flanges 144 and 146 which, in turn, extend upwardly from a support plate 148. Also, fixedly mounted on the shaft 140 are a plurality of helix or worm gears 150, 152 and 154 with the gear 150 having a left-hand thread and the gears 152 and 154 having a right-hand thread. A plurality of shafts 156, 158, and 160 are rotatably supported by the legs 162 and 164 of a U-shaped support member 166 such that they lie below and are perpendicular to the shaft 140. A gear 168, 170, and 172 is mounted on each of the shafts 156, 158 and 160, respectively, such that each one not only rotates independently of its respective shaft, but also can be moved along the axis of the shaft between driving and non-driving positions. The gears 168, 170 and 172 are mounted in mesh with the gears 150, 152, and 154, respectively, both in the driving and non-driving positions. A face of each of the gears 168, 170, and 172 includes an ear 174, 176 and 178, respectively, with the ear 176 being located on a face of the gear 170 which is opposite to the faces of the gears 168 and 172 which contain the other ears, as best seen in FIG. 9.

The ear 174 is adapted to be moved into driving engagement with an ear 180 located on one end of a member 182 which is fixedly mounted on the shaft 156. A drive member 183 is coupled to the shaft 156 by a clutch (not shown). The member 183 includes a pair of spaced protrusions 184 and 186 which are adapted to drivingly engage opposite sides of the member 104 located within the hollow film spool 102, as will be explained shortly. A disc 188 is mounted on the drive member 183 for rotation therewith. The entire periphery of the disc 188 is provided with a plurality of slots 190 (only six being shown in FIG. 9) which are adapted to cooperate with a counter assembly (not shown) for determining the length of film which has been withdrawn (and/or rewound) from the film cassette 96. For example, the counter assembly may include a photocell circuit which would respond to light passing through the individual slots 190 as they are rotated past a light source for determining such length. Alternatively, the counter assembly may merely be a mechanical sensor mounted in engagement with the periphery of the disc 188 which would count the slots 190 as they moved therepast.

The ear 178 is adapted to be moved into driving engagement with an ear 192 located on one end of a member 194 which is fixedly mounted on the shaft 160. A drive member 195 is also fixedly mounted on one end of the shaft 160. The drive member 195 includes a pair of spaced protrusions 196 and 198 which are adapted to drivingly engage a planar member 200 located within a passageway 202 in the spool 46.

The ear 176 is adapted to be moved into driving engagement with an ear 204 which protrudes from one end of a member 206 which is fixedly mounted on the shaft 158. The shaft 158 is coupled to the leg 162 of the U-shaped member 166 by a one-way brake 208 which permits unimpeded drive of the shaft 158 in the counterclockwise direction, as viewed in FIG. 9, and applies a drag or resistance to rotation of the shaft 158 in the opposite direction so as to limit its rotational speed and prevent free wheeling of the take-up roller 56.

A drive member 210 is fixedly attached to the shaft 158. The drive member 210 includes a pair of spaced protrusions 212 and 214 which are adapted to drivingly engage opposite sides of a planar member 216 located within a passageway 218 in the take-up spool 56. Like planar member 200, member 216 is preferably an integral part of its respective spool.

During the loading of the kit 10 into the chamber 124 of the processor 126, the drive members 183, 210 and 195 extend through openings 220, 222 and 224, respectively, in the side wall 22 of the housing 12 so as to locate their respective protrusions 184, 186, 212, 214, 196 and 198 on opposite sides of the planar members 104, 216 and 200.

The processing of the exposed film 106 is initiated by actuating a switch 226 thereby energizing the motor 132. The motor 132 drives the shaft 134 and gear 136 in a clockwise direction thereby rotating the gear 138, shaft 140 and worn gears 150, 152 and 154 in a counterclockwise direction, as viewed in FIG. 9. Because of the angular relationship between the worm gears 150, 152 and 154 and their associated gears 168, 170 and 172, respectively, rotation of the former in a counterclockwise direction is effective, because of the tangential driving forces therebetween, to not only rotate the gear 168 in a clockwise manner and the gears 170 and 172 in an opposite direction, but also cause the gears 168, 170 and 172 to move along their respective shafts 156, 158, and 160 in the direction of the arrows shown in FIG. 9. Such translational movement is effective to move the gears 168 and 172 in a direction which moves their respective ears 174 and 178 out of driving relation with the ears 180 and 192 while simultaneously moving the gear 170 in a direction which results in its ear 176 moving into driving engagement with the ear 204 of member 206. Each of the shafts 156, 158, and 160 include means (not shown) for limiting the movement of its respective gear into its non-driving position. Accordingly, only the drive member 210 is being driven by the motor 132.

The motor drive to drive member 210 is effective to rotate the take-up roller 56 in a counterclockwise direction, as viewed in FIG. 2. Such rotation results in the sheet material 84 being unwound from the roller 46 and the film 106 being withdrawn from the film cassette 96. Initial movement of the sheet material 84 is effective to peel the seal 94 from sealing engagement with the nozzle 72 thereby permitting the latter to apply a coating of the processing liquid 70 to the gelatin-coated side 92 of the sheet material 84. Further movement of the sheet material 84 is effective to completely disengage the seal 94 from the liquid dispenser 68. Accordingly, it can be seen that counterclockwise rotation of the take-up roller 56 results in a laminate consisting of a layer of processing liquid 70 sandwiched between the sheet material 84 and the exposed film 106 being wound in superposition upon the take-up roller 56. Rotation of the take-up roller continues until the aforementioned film counter indicates that a predetermined length of the film has been withdrawn from its film cassette and shuts the motor 132 off.

Figure 5:
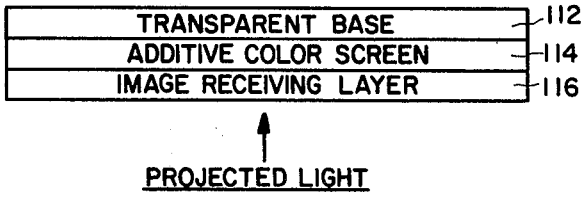
FIG. 5 is a view similar to FIG. 4 showing the film after it has been stripped from the flexible sheet material.
Figure 6:
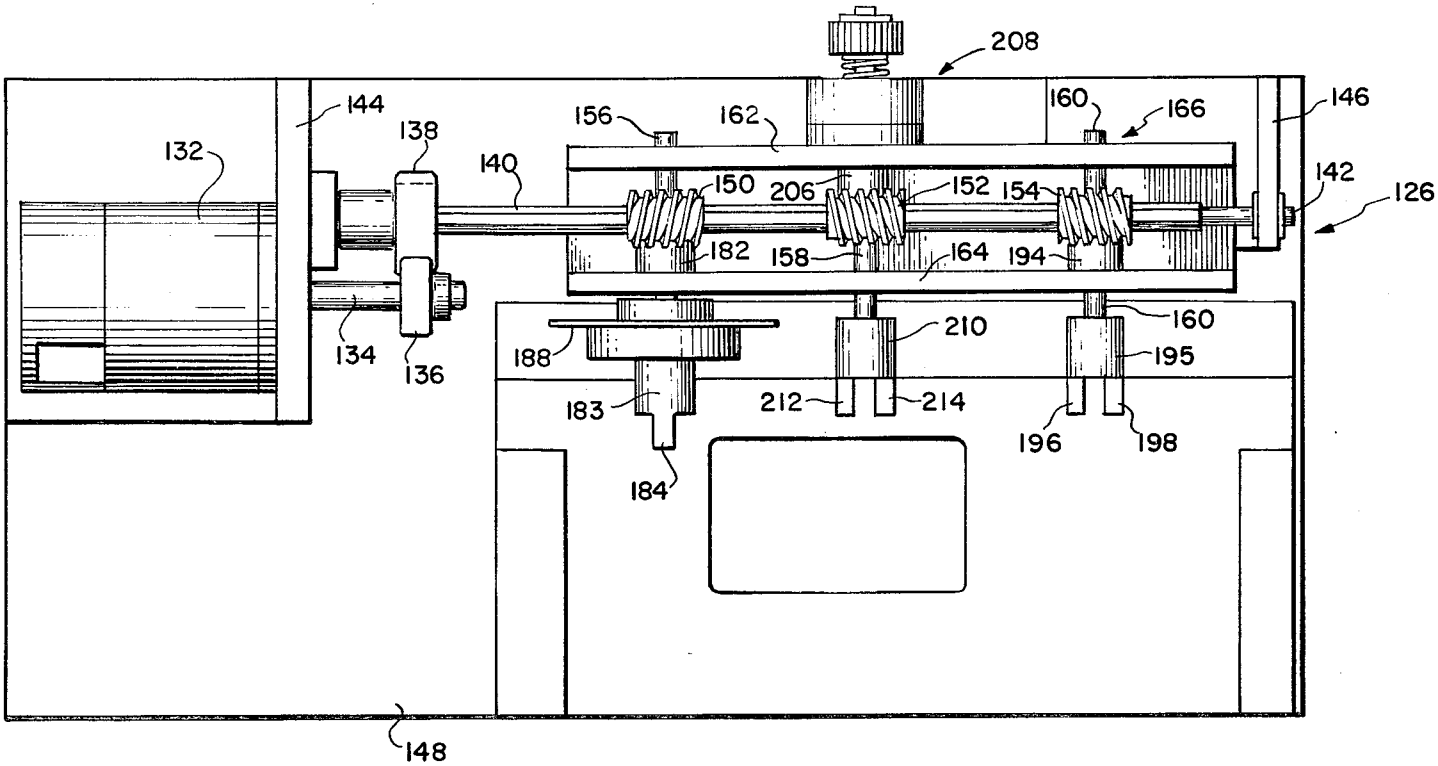
FIG. 6 is a top elevational view of the drive system of the processor shown in FIG. 1 with the side, end and top walls of the processor housing omitted for reasons of clarity.
Figure 7:
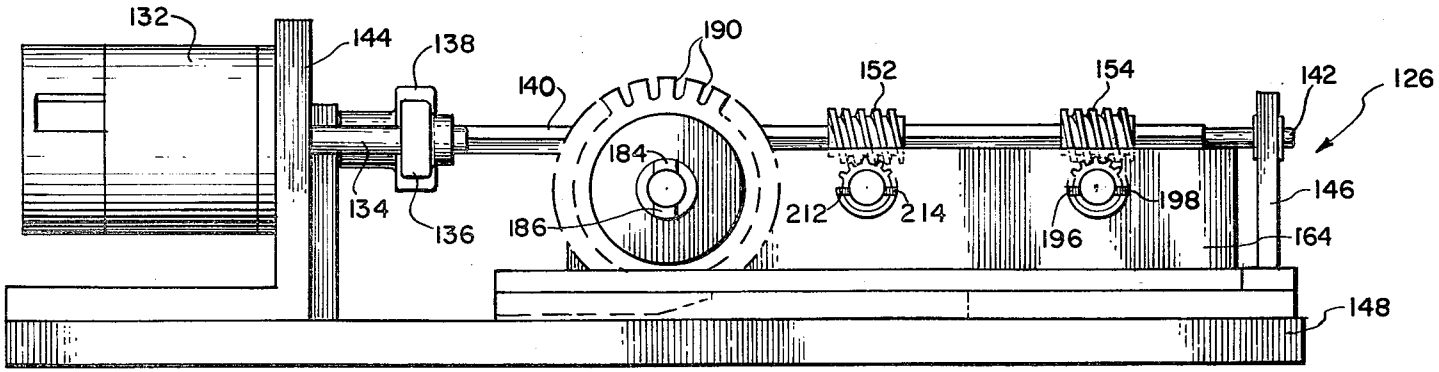
FIG. 7 is a side elevational view of the drive system shown in FIG. 6.

The laminate consisting of the film 106, the layer of processing liquid 70, and the sheet material 84 are permitted to remain coiled upon the take-up roller 56 until the processing liquid has imbibed the film to an extent where processing of the film has been completed and the laminate now includes visible images, preferably within the image-receiving layer 116 of the film 106. The motor 132 is then energized in an opposite direction so as to drive the shaft 140 in a clockwise manner, as viewed in FIG. 9. Such rotation results in the gears 168, 170 and 172 moving along their respective shafts such that the ears 174 and 178 of gears 168 and 172 move into driving engagement with the ears 180 and 192 of members 182 and 194, respectively; and the ear 176 of gear 170 moves out of driving engagement with the ear 204 of member 206. Accordingly, drive member 183 is now driven in a counterclockwise direction, drive member 195 in a clockwise manner, and the drive member 210 is disconnected from the motor 132. As the film spool 102 and the roller 46 are rotated in opposite directions under the driving influence of the drive members 183 and 195, respectively, the laminate is continuously removed from the take-up roller 56 and the film 106 is stripped from the sheet material 84, such stripping being facilitated by a tapered bar 228 (see FIG. 2) which has a width substantially equal to that of the film 106. Subsequent to processing, the photosensitive layer 120 exhibits a greater adhesion to the sheet material 84 than to the next adjacent layers whereby removal of the sheet material 84 serves to remove the photosensitive layer 120 thus increasing visual acuity and brightness of the resultant transparency, shown in FIG. 5, and enhancing its stability by virtue of the removal of residual processing liquid 70 in the photosensitive layer 120. In a particularly preferred embodiment, the stripping layer 118 is employed to facilitate removal of the photosensitive layer 120. For further details of the film, reference may be had to U.S. Pat. No. 3,682,637 granted to E. H. Land on Aug. 8, 1972.

Alternatively, the visible images may be formed in the sheet material 84. In this case, the film 106 would be comprised of a photosensitive layer through which the exposure would be made and a base which may or may not be transparent. Also, the sheet material 84 would be comprised of a transparent base and an image-receiving layer. Subsequent to the exposure of the film, the side of the sheet material containing the image-receiving layer would be coated with the processing liquid and brought into engagement with the side of the film through which the exposure had been made. After the sheet material had been returned to the roller 46, it would be removed and the individual scenes cut and mounted for subsequent viewing. For further details of the film and sheet material, reference should be had to U.S. Pat. No. 2,983,606, granted to H. G. Rogers on May 9, 1961.

After the film 106 and sheet material 84 have been rewound upon the film spool 102 and the roller 46, the motor 132 is stopped and the kit 10 removed from the processor 126. The kit 10 may then be opened and the film assemblage removed therefrom such that the processed film may then be withdrawn from the film cassette and the individual frame cut and mounted for subsequent viewing. The door 30 of the kit 10 is then secured in the closed position thereby safely enclosing the by-products of the processing operation.

Since certain changes may be made in the above apparatus without departing from the scope of the invention herein involved, it is intended that all matter contained in the above description or shown in the accompanying drawings shall be interpreted as illustrative and not in a limiting sense. For example, while the invention has been described as one wherein a positive transparency has been obtained, the invention applies equally as well to reflection-type prints. Also, while the kit 10 has been described as being purchasable as a unit, it should be understood that, preferably, it would be sealed within a vapor and/or moisture proof envelope so as to preserve the freshness of the enclosed materials.

What is claimed is:

1. A disposable kit configured to be placed in a film processor wherein it is adapted for use in the processing of a photographically exposed roll of instant-type transparency film contained within the kit, said kit comprising:

a housing defining a chamber for receiving components of said kit, said housing including means for providing access to said chamber;

first means mounted within said chamber for rotatably supporting a roll of flexible sheet material;

a length of flexible sheet material having first and second ends, said sheet material being wound about said first means with said first end attached thereto;

a film assemblage of the type adapted for use in a conventional 35 mm camera mounted within said chamber, said film assemblage including a film cassette having an exit slot therein, a film spool, and a length of unexposed photographic film of the instant transparency type wound about said spool with a first end attached to said spool and a second end thereof extending to the outside of said film cassette via said film exit slot, said film cassette being adapted to be removed from said chamber and placed in a camera wherein said film is adapted to be withdrawn from said film cassette, exposed, and rewound into said film cassette, whereupon said film cassette with said exposed film may be removed from the camera and returned to said chamber;

second means rotatably mounted within said chamber, said second means having means adaptable to receive said second ends of said exposed film and said sheet material;

an applicator adapted to apply a layer of processing liquid to one side of either said exposed film or said sheet material; and means coupled to said second means and adapted to be driven by a drive means of a film processor in a direction so as to wind a laminate comprised of said exposed film and said sheet material with a layer of processing liquid located therebetween upon said second means for a period of time sufficient to initiate the formation of visible images within said laminate.

2. A disposable kit as defined in claim 1 wherein said first means further includes drivable means for rotating said first means, subsequent to said period of time, in a direction so as to unwind said laminate from said second means and rewind said sheet material upon said first means, and means for stripping said exposed film from said sheet material as the latter is being rewound upon said first means.

3. A disposable kit as defined in claim 2 wherein said drivable means is adapted to be driven by the drive means of the film processor.

4. A disposable kit configured to be placed in a film processor wherein it is adapted for use in the processing of a photographically exposed roll of instant-type transparency film contained within the kit, said kit comprising:

a housing defining a chamber for receiving components of said kit, said housing including means for providing access to said chamber;

first means mounted within said chamber for rotatably supporting a roll of flexible sheet material;

a length of flexible sheet material having first and second ends, said sheet material being wound about said first means with said first end attached thereto;

a film assemblage of the type adapted for use in a conventional 35 mm camera mounted within said chamber, said film assemblage including a film cassette having an exit slot therein, a film spool, and a length of unexposed photographic film of the instant transparency type wound about said spool with a first end attached to said spool and a second end thereof extending to the outside of said film cassette via said film exit slot, said film cassette being adapted to be removed from said chamber and placed in a camera wherein said film is adapted to be withdrawn from said film cassette, exposed, and rewound into said film cassette, whereupon said film cassette with said exposed film may be removed from the camera and returned to said chamber;

second means rotatably mounted within said chamber, said second means having means adaptable to receive said second ends of said exposed film and said sheet material;

an applicator adapted to apply a layer of processing liquid to one side of either said exposed film or said sheet material;

means coupled to said second means and adapted to be driven by a drive means of a film processor in a direction so as to wind a laminate comprised of said exposed film and said sheet material with a layer of processing liquid located therebetween upon said second means for a period of time sufficient to initiate the formation of visible images within said laminate;

said first means further includes drivable means for rotating said first means, subsequent to said period of time, in a direction so as to unwind said laminate from said second means and rewind said sheet material upon said first means;

means for stripping said exposed film from said sheet material as the latter is being rewound upon said first means; and said film spool further includes means engageable by the drive means of the film processor for rotating said film spool, subsequent to said period of time, in a direction so as to rewind said exposed film thereupon as said sheet material is being rewound upon said first means.

5. A disposable kit configured to be placed in a film processor wherein it is adapted for use in the processing of a photographically exposed roll of instant-type transparency film contained within the kit, said kit comprising:

a housing defining a chamber for receiving components of said kit, said housing including means for providing access to said chamber;

first means mounted within said chamber for rotatably supporting a roll of flexible sheet material;

a length of flexible sheet material having first and second ends, said sheet material being wound about said first means with said first end attached thereto;

a film assemblage of the type adapted for use in a conventional 35 mm camera mounted within said chamber, said film assemblage including a film cassette having an exit slot therein, a film spool, and a length of unexposed photographic film of the instant transparency type wound about said spool with a first end attached to said spool and a second end thereof extending to the outside of said film cassette via said film exit slot, said film cassette being adapted to be removed from said chamber and placed in a camera wherein said film is adapted to be withdrawn from said film cassette, exposed, and rewound into said film cassette, whereupon said film cassette with said exposed film may be removed from the camera and returned to said chamber;

second means rotatably mounted within said chamber, said second means having means adaptable to receive said second ends of said exposed film and said sheet material;

an applicator adapted to apply a layer of processing liquid to one side of either said exposed film or said sheet material;

means coupled to said second means and adapted to be driven by a drive means of a film processor in a direction so as to wind a laminate comprised of said exposed film and said sheet material with a layer of processing liquid located therebetween upon said second means for a period of time sufficient to initiate the formation of visible images within said laminate; and said first means and said film spool include means engageable by the drive means of the film processor for rotating said first means and said film spool, subsequent to said period of time, in a direction so as to strip said exposed film from said sheet material as said laminate is being unwound from said second means while simultaneously rewinding said exposed film upon said film spool and said sheet material upon said first means.

6. A disposable kit as defined in claim 5 wherein said applicator applies a layer of processing liquid to one side of said sheet material and said visible images are formed in said film.

7. A disposable kit as defined in claim 5 wherein said housing includes a wall containing a plurality of apertures for facilitating the connection between said engageable means and the drive means of the film processor.

8. A disposable kit as defined in claim 7 wherein said housing includes a second wall, said second wall being opaque.

* * * * *